US006109954A

United States Patent [19]

Lin

[11] Patent Number: 6,109,954

[45] Date of Patent: Aug. 29, 2000

[54] STRAIN RELIEF APPARATUS FOR USE IN A COMMUNICATION PLUG

[75] Inventor: Chen-Chieh Lin, Indianapolis, Ind.

[73] Assignee: Lucent Technologies, Inc., Murray Hill, N.J.

[21] Appl. No.: 09/126,166

[22] Filed: Jul. 30, 1998

[51] Int. Cl.[7] ..... H01R 13/58

[52] U.S. Cl. ..... 439/460; 439/462

[58] Field of Search ..... 439/470, 460, 439/461, 462, 417, 418, 456, 457, 458, 459, 404, 409, 934

[56] References Cited

U.S. PATENT DOCUMENTS 4,737,122 4/1988 Dechelette ..... 439/418

5,211,576 5/1993 Tonkiss et al. ..... 439/462

5,573,423 11/1996 Lin et al. ..... 439/462

*Primary Examiner*—Paula Bradley

*Assistant Examiner*—Alexander Gilman

[57] ABSTRACT

A strain relief housing for use in a modular communication plug has a divider member dividing a central bore of the plug into four channels, each channel being adapted to contain two conductors from the cable being terminated. Septa members extend from the rear of the divider to the rear of the housing and are insertable into the cable so that separation and segregation of the conductors actually commences within the cable. A compression ring surrounds the cable and is insertable within the rear of the plug housing where it is compressed to clamp or anchor the cable.

16 Claims, 9 Drawing Sheets

STRAIN RELIEF APPARATUS FOR USE IN A COMMUNICATION PLUG

CROSS-REFERENCE TO RELATED APPLICATION

This application is related to U.S. patent application Ser. No. 09/126,042 of C. C. Lin for "An Anchoring Member For A Communication Cable" (Lin Case 8), filed concurrently herewith.

FIELD OF THE INVENTION

The present invention relates generally to the field of modular communication plugs for terminating cables or conductors, and more particularly, to a strain relief plug for use in a modular connector.

BACKGROUND OF THE INVENTION

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and standard round or sheathed cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon cable providing the necessary insulation. Conversely, the conductors packaged in a standard round cable may take on a random or intended arrangement with conductors of conductor pairs being twisted or wrapped around one another and with the pairs changing relative positions throughout the cable length.

Most modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals will electrically engage jack springs inside the jack to complete the connection.

A common problem found in these modular plugs is for the conductors to pull away or be pulled away from the terminals inside the plug structure. This can be caused by persons accidentally pulling on the cable, improperly removing the plug from a jack or merely from frequent use. The stress on the connections between the conductors and the plug terminals has been alleviated in prior art devices which include an anchoring member or anchor bar in the housing of the dielectric structure. In these designs, the dielectric structure, ie., the plug, contains a chamber for receiving the cable. The cable is then secured within the chamber via pressure exerted upon the cable jacket by the anchoring member or anchor bar in conjunction with one or more of the chamber walls. U.S. Pat. Nos. 5,186,649 and 4,002,392 to Fortner et al. and Hardesty contain examples of such strain relief apparatus.

While these modular plugs with anchor bars have been effective in providing strain relief to ribbon type cables, standard round cables or cords pose additional strain relief problems. In U.S. patent application Ser. No. 08/922,621 of Chapman et al., filed Sep. 3, 1997, the disclosure of which is incorporated herein by reference, a plug for terminating a round cable has an anchor bar for holding the cable. While an anchor bar does function to secure the cable, it deforms the cable or cord and presses the individual leads together randomly. As a consequence there is introduced a random variable in performance of the plug as a result of increased cross talk among the conductors or leads, which, as a consequence, makes it difficult to predict a plug's electrical characteristics. The high degree of variability can also result in reduced signal carrying performance.

This process of terminating a round cable introduces significant variability in connecting the conductors to the plug terminals and places additional strain on the connections between the conductors and the plug terminals. Because the individual conductors in a conductor pair are often twisted around one another and the conductor pairs themselves are often twisted around one another, the conductor configuration a technician sees when the cable is cut changes based on the longitudinal position of the cut in the cable. The technician generally is forced to translate the conductor configuration into a side by side orientation matching the pattern of the terminals in the plug. Moreover, the necessity of splitting the conductors in at least one of the pairs, which is an industry standard, presents another potential for error in making the connections to the plug terminals. In addition, orienting the conductor positions from an essentially circular arrangement into a planar arrangement places additional stress on the conductor-terminal connections.

U. S. Pat. No. 5,496,196 to Winfried Schachtebeck discloses a cable connector in which the connector terminals are arranged in a circular pattern to match more closely the arrangement of conductors held in a round cable. However, the Schachtebeck invention attempts to isolate each individual conductor and apparently requires all conductor pairs to be split before termination to the connector.

In addition, the economic aspects of the prior art necessity for the installer to separate out the twisted pairs of conductors and route them to their proper terminals in the plug are of considerable moment. Even if the installer, splicer, or other operator is accurate in the disposition of the conductors, the time consumed by him or her in achieving such accuracy is considerable. Thus, in a single work day, the time spent in properly routing the conductors can add up to a large amount of time, hence money. Where it is appreciated that thousands of such connections are made daily, involving at least hundreds of installers, it can also be appreciated that any reduction in time spent in mounting the plug can be of considerable economic importance.

The plug should demonstrate predictable results, including a minimization of variation in signal transmission, and, at the same time, it should be of a simple and economically viable construction for use in the field.

SUMMARY OF THE INVENTION

The present invention is a strain relief plug for use in a high frequency modular connector, wherein the pairs of wires are separated from each other at the cable entrance end of the plug and the separation is maintained throughout the length of the plug to the connector end thereof. In greater detail, the interior bore of the plug has a divider within the bore in the region of the connector end, a cruciform shaped member extending toward the cable end which is insertable into the cable jacket. Thus four parallel channels are formed within the plug bore, each channel being adapted to carry one twisted pair of conductors from within the cable to the connector end. The connector end of the plug, the pairs of wires are properly arranged for connection to the remainder of the connector. The divider also functions as a cable stop.

Instead of the typical prior art anchor bar, the plug of the invention has an elongated compression ring which fits around the cable and is, upon insertion into a tapered portion of the plug bore, gradually compressed to where it grips the cable tightly. A latching projection on the compression ring or sleeve mates with a latch opening in the plug at a point where the ring is near maximum compression. Thus, th& ring, gripping the cable, is held within the bore of the plug, and resists pulling stresses because of the latching feature.

Inasmuch as the cruciform divider extends into the compression ring bore and partially into the cable, the conductors are maintained in proper position and orientation, unaffected by the compressive force of the compression ring. Hence, the transmission characteristic variability of the prior art devices resulting the conductors being pressed together in a random fashion due to the force of the anchor bar is substantially eliminated or, at least, greatly reduced. As a consequence, modular connectors using the strain relief plug of the present invention have a much higher performance predictability than do prior art connectors.

The numerous features and advantages of the present invention will be more readily apparent from the following detailed description read in conjunction with the accompanying drawings.

DETAILED DESCRIPTION

Figure 1:
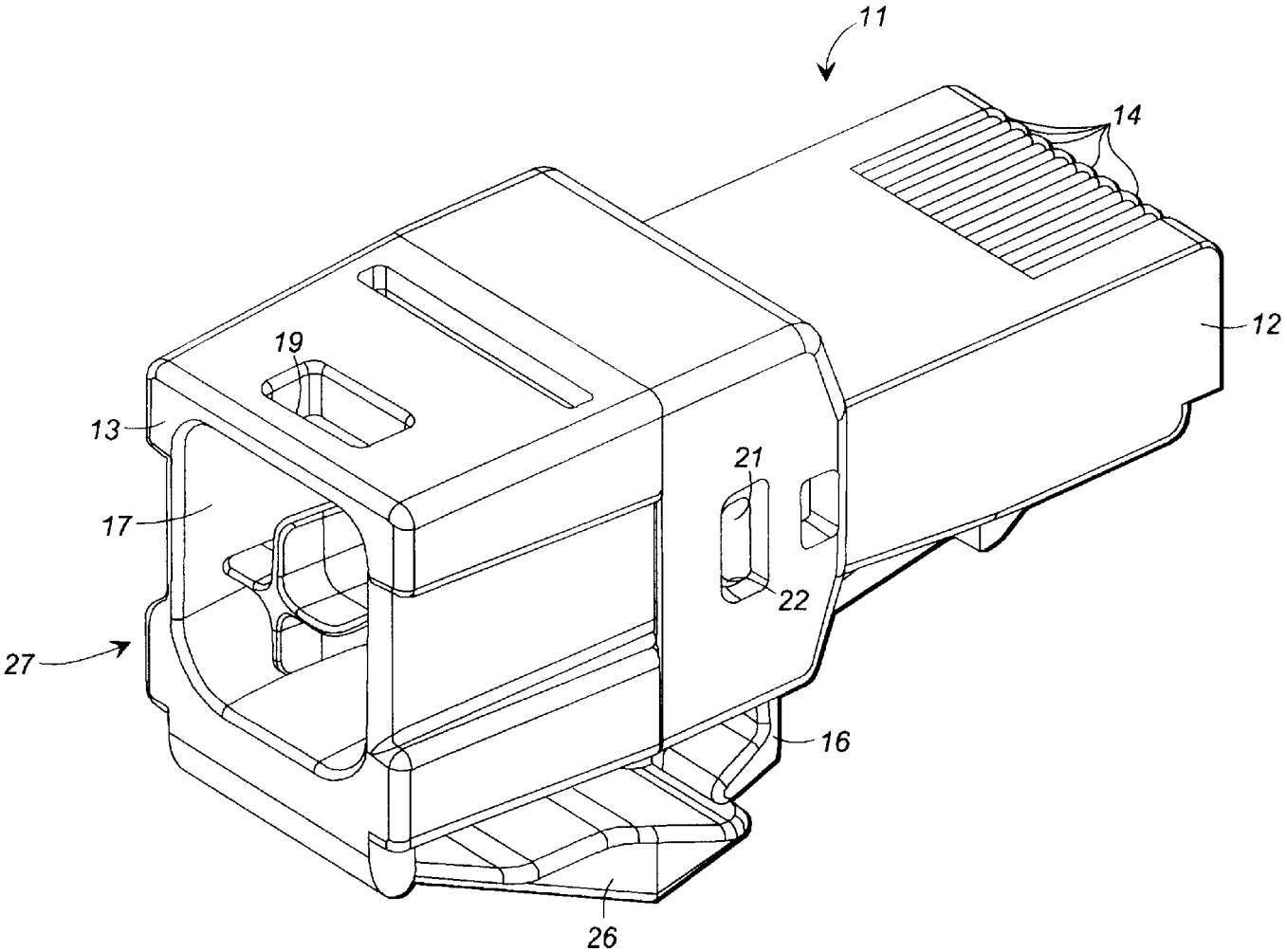
FIG. 1 is a perspective view of a modular communication connector having the strain relief plug of the presenting invention.

In FIG. 1 there is shown a high frequency communication plug connector 1 which comprises a jack interface housing 12 and a strain relief housing 13, both of which are preferably made of a suitable plastic material. Jack interface housing 12, which is substantially the same as the jack interface housing shown and described in the aforementioned Chapman et al. application Ser. No. 08/922,621 comprises a substantially hollow shell having side walls and upper and lower walls. A plurality of slots 14 on one end of housing 12 are adapted to receive jack springs contained in a terminal block or jack, not shown. The number of slots 14 and the dimensions of housing 12 are dependent on the number of conductors to be terminated or connected and the shape of the jack in the terminal block. Housing 12 includes a resilient latching arm 16 extending from the lower surface thereof at an angle, as shown. When housing 12 is inserted into a jack, pressure applied to the distal end of the arm 16 depresses it to facilitate entry into the jack, after which the pressure is removed and the arm 16 returns to its locking position as shown in FIG. 1, where it latches to the jack. Removal of housing 12 from the jack is accomplished by application of pressure on the distal end of arm 16, thereby unlatching it.

Figure 2A:
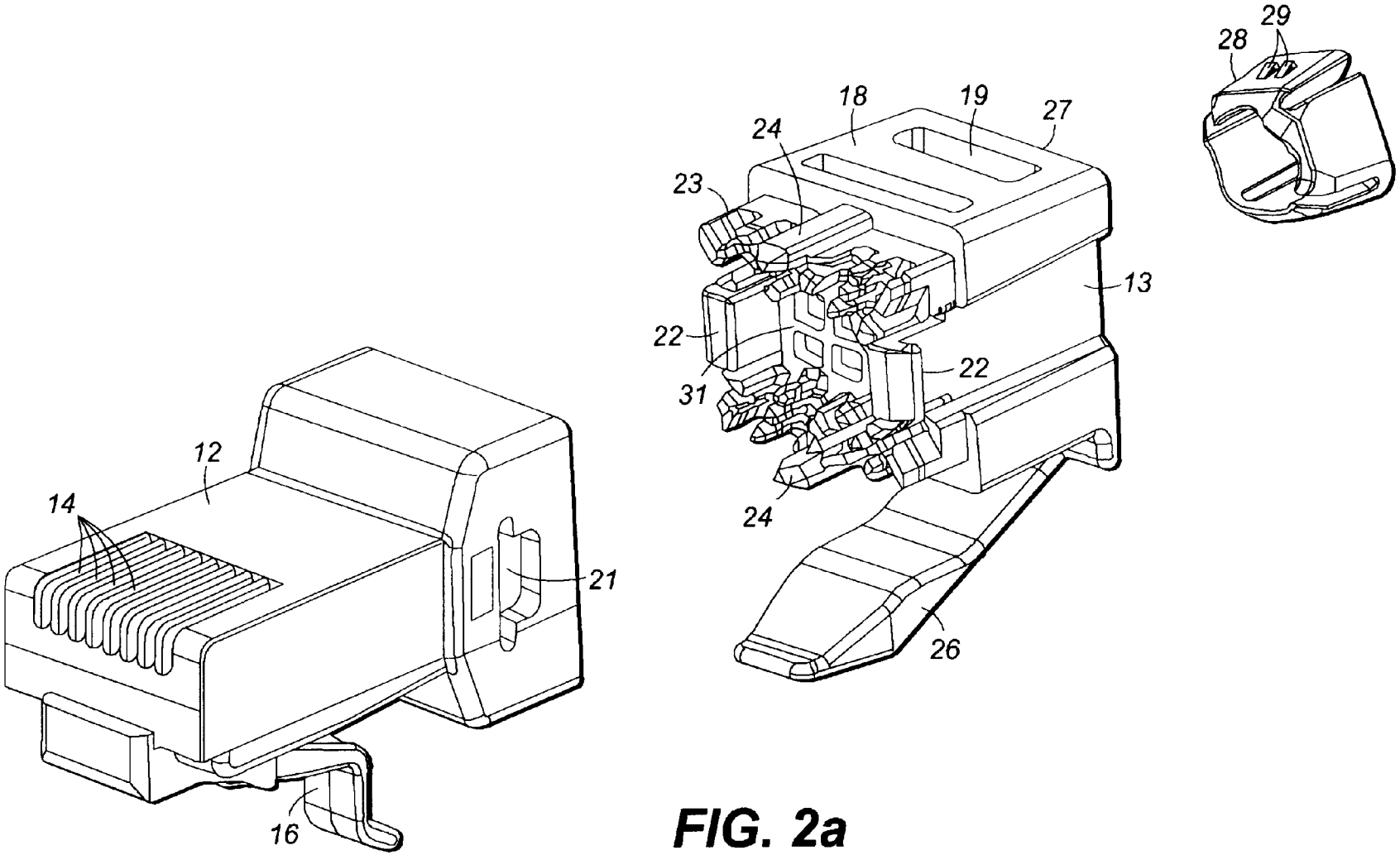
FIG. 2*a* is an exploded perspective view of the connector of FIG. 1.

The second major component of connector 11 is strain relief housing 13 which has a substantially rectangular opening 17 which, as will be discussed more fully hereinafter, provides entry for a cable containing conductors to be terminated. Within opening 17 is a cruciform system arrangement 20, which will be discussed in detail hereinafter. Opening 17 may have a rectangular or a circular cross-section. The top surface 18 of housing 13 has a rectangular opening 19 which, as will be explained hereafter, is involved in the strain relief feature of the invention. Two side apertures 21, only one of which is shown, in the side walls of housing 12 are for receiving spring latches 22 on either side of housing 13 to secure the two housings 12 and 13 together. As best seen in FIG. 2*a*, extending from the front or connector face 23 of housing 13 are alignment guides 24 which align with channels (not shown) in housing 12, as explained in the aforementioned Chapman et al application Ser. No. 08/922,621 to insure proper alignment of the two housings 12 and 13 when they are snapped together. For ease in removing connector 11 from a jack into which it is plugged, housing 13 is provided with a cantilevered trigger arm 26 which extends from the lower surface of housing 13 adjacent the cable receiving end 27 thereof, and at an angle thereto so that its distal end overlaps the distal end of latching arm 16, as seen in FIG. 1, when the housing 12 and 13 are latched together. Thus, arm or trigger 26 functions to actuate arm 16 and depress it to its release point when pressure is applied to arm 26. In addition to the convenience of such an arrangement, the overlap also prevents cables or wires from snagging on arm 16 or from lodging between arm 16 and housing 12, which presents a potential for damage to the connector or to the wires.

Figure 2B:
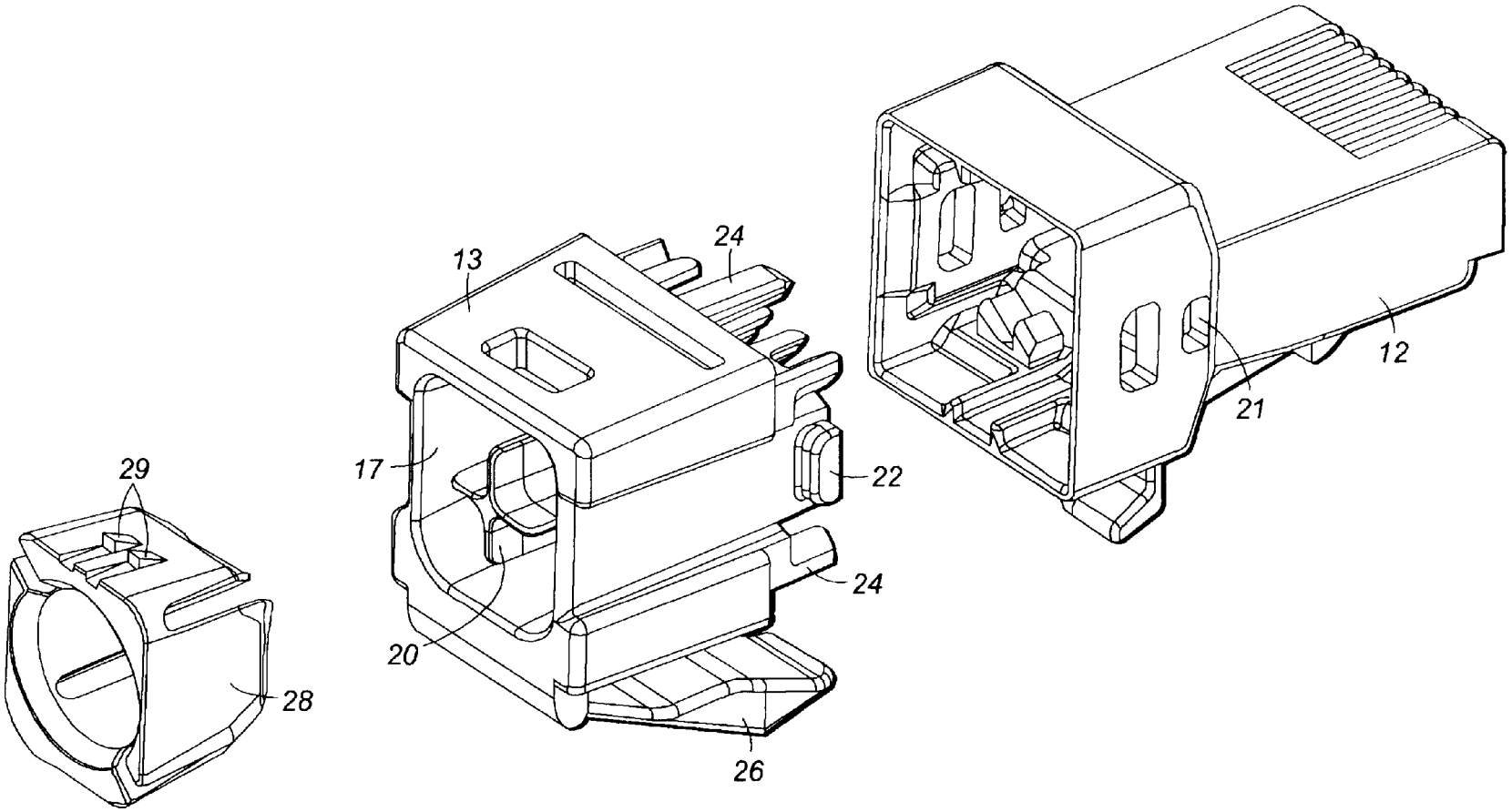
FIG. 2*b* is another exploded perspective view of the connector of FIGS. 1 and 2*a*, from a different angle of view.
Figure 2C:
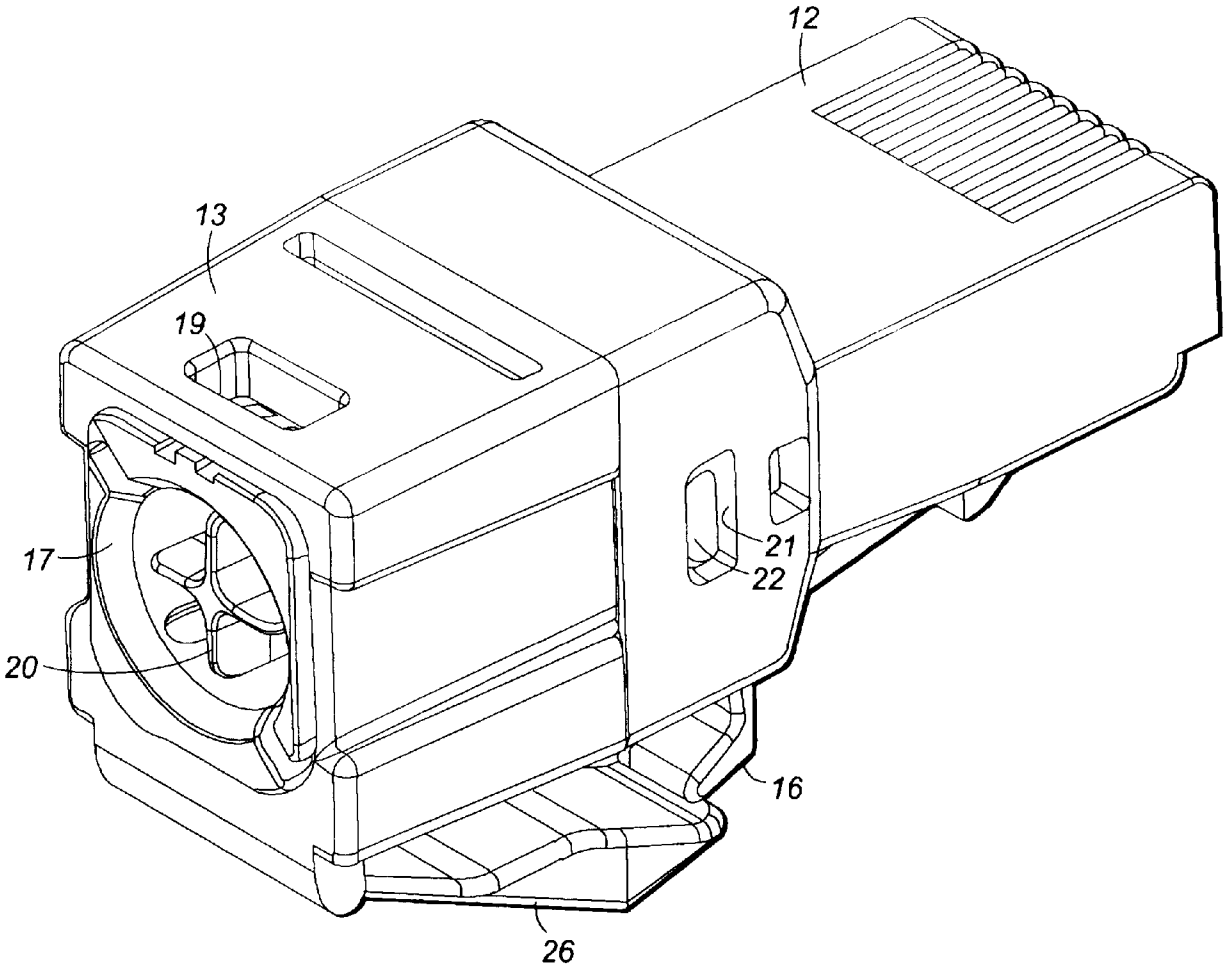
FIG. 2*c* is a perspective view of the connector of FIG. 1 with the compression ring of the invention in place.

As was discussed hereinbefore, and as shown in FIGS. 2*a* and 2*b* a compression ring 28 is designed and configured to fit over the cable being terminated and to be insertable into the cable receiving end 27 of housing 13. When latched in place by means of latch projections 29 engaging the edge of opening 19, the cable is tightly but uniformly gripped and thus attached to housing 13 as will be explained in greater detail hereinafter. FIG. 2*c* illustrates the compression ring 28 in place within bore 17, but without the cable.

Figure 3:
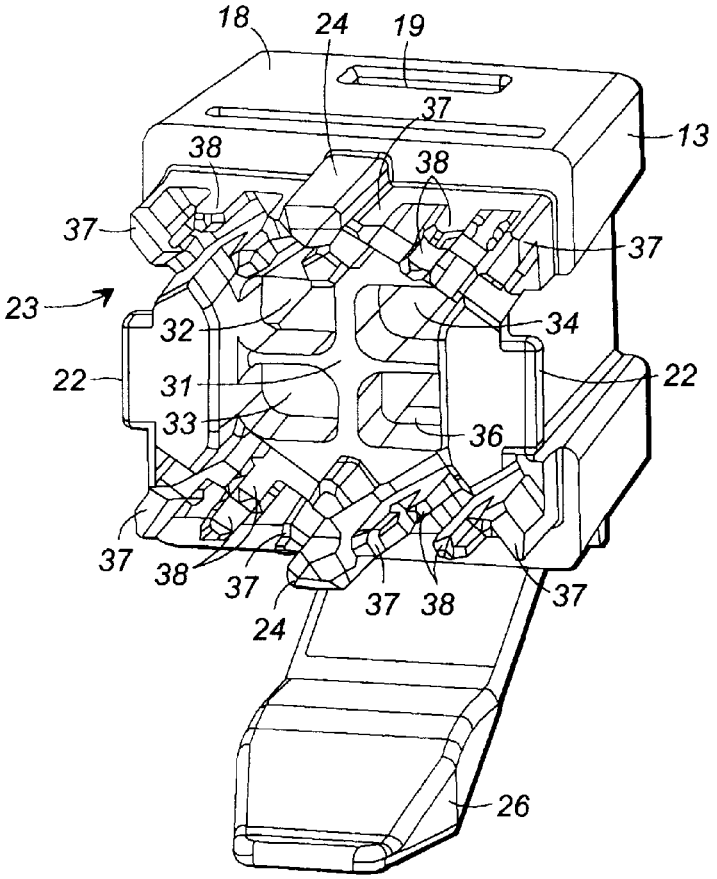
FIG. 3 is a perspective view of the front of the strain relief plug of the invention.
Figure 5:
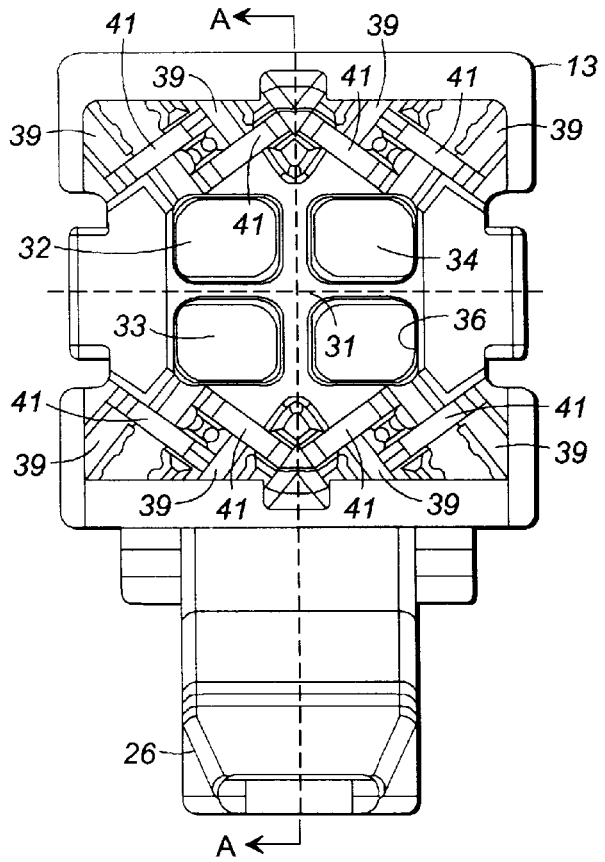
FIG. 5 is an elevation view of the front of the strain relief plug of the invention.

In FIG. 3, which is a perspective view of the plug 13 of the invention showing, in detail, the front or connector face 23 thereof, there is shown the arrangement for holding and organizing the individual wires carried by the cable being terminated, and FIG. 5 depicts the front face 23 in detail. Located within the interior bore 17 of plug 12 is a cruciform divider 31 which forms four substantially rectangular channels 32, 33, 34, and 36 for segregating pairs of wires (not shown) contained in the cable. In the illustrative embodiment shown, eight wires, or four pairs. Extending from the front face 23 are a plurality of conductor segregation prongs 37 and a plurality of conductor control channels 39, as is best seen in FIG. 5, for receiving and holding the insulated conductors from the cable. The prongs 37 and 38, and the channels 39, are radially spaced from the center of the divider 31, and these are two channels 39 for each of the openings 32, 33, 34, and 36. The segregation prongs 37 function to maintain each conductor pair separate from the other conductor pairs, and the separating prongs 38 function to separate the conductors in each pair from each other. The segregation prongs 37 are preferably larger than the separating prongs 38 so that crosstalk between conductor pairs is minimized. As will be more fully apparent hereinafter, the arrangement of a cruciform divider 31 and the prongs 37, 38, along with channels 39, materially simplify the organization of the conductors within the plug 13 which at the same time reducing crosstalk among the conductor pairs. The prongs 37 and 38 are bifurcated thereby forming insulation displacement connector (IDC) control channels 41, as best seen in FIG. 5 for receiving the IDC ends of conductive members contained in housing 12, which function to connect the ends of the cable conductors to the slots 14 and hence the jack springs, as explained in the Chapman et al. application Ser. No. 08/922,621. As can best be seen in FIG. 5, the positioning of the conductor pairs in, roughly, the four comers results in a radial array which greatly reduces the difficulties involved in routing the conductors from the cable. The separate channels formed by the openings 32, 33, 34, and 36, as will be discussed hereinafter, materially assist in achieving the proper routing.

Figure 4:
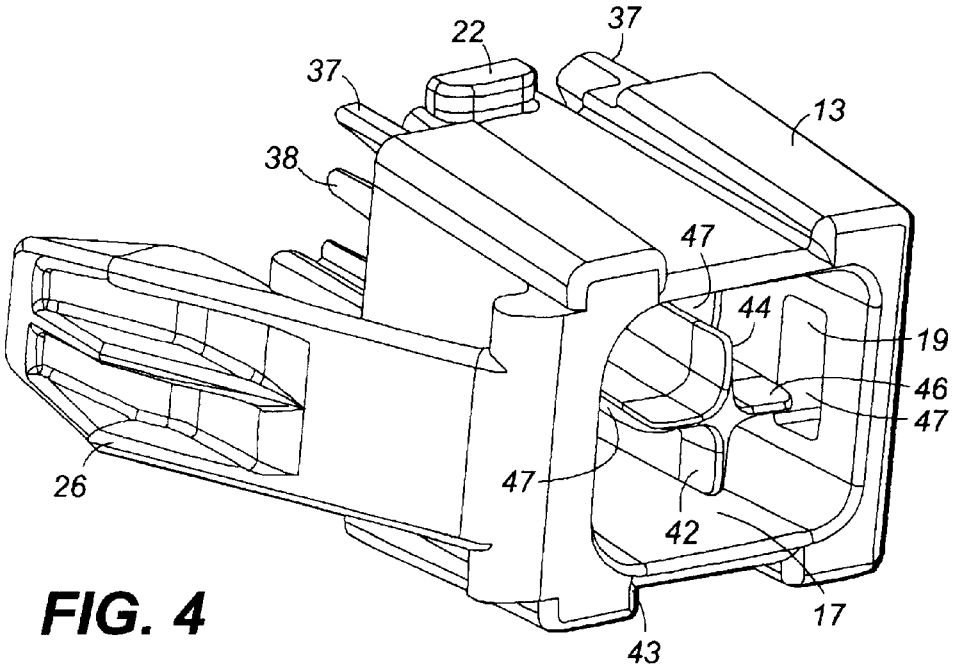
FIG. 4 is a perspective view of the rear of the strain relief plug of the invention.
Figure 6:
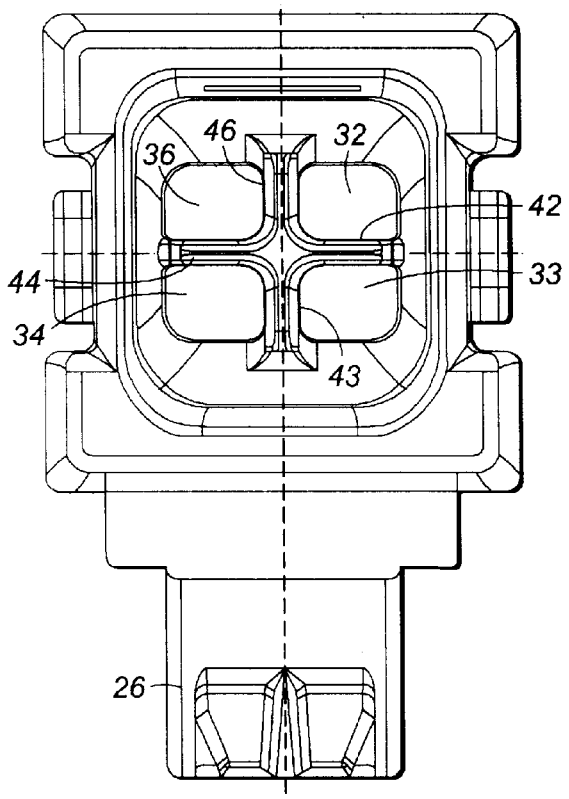
FIG. 6 is an elevation view of the rear of the strain relief plug of the invention.
Figure 7:
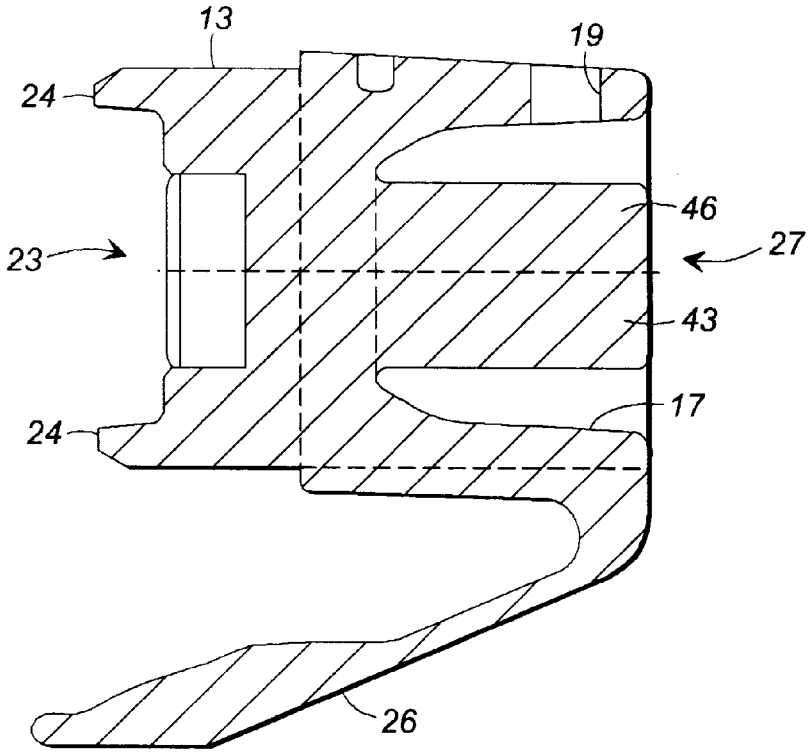
FIG. 7 is a cross-section view along the line A—A of FIG. 5.

FIG. 4 is a perspective view of the housing or plug 13 as viewed from the cable entrance end 27 thereof, and FIG. 6 is an elevation view thereof. As can be seen, extending from the rear face of divider 13 are four septa 32, 43, 44, and 46 which do not, as seen in FIG. 4, extend all the way to the interior walls of the interior bore 16, thereby forming gap 47 between their ends and the walls. The septa are arranged in a cruciform configuration, and form continuations of the channels formed by openings 32, 33, 34, and 36 in divider 31. The gaps 47 formed between the septa and the walls accommodate the cable jacket when it is inserted into bore 17, and the rear of divider 31 serves as a cable stop. Thus, when the cable is inserted into bore 17, each of the channels formed by the septa contains one pair of conductors which are untwisted from each other and substantially parallel. Inasmuch as the septa extend to the cable receiving or entrance end 27 the conductors are separated over a considerable distance as compared to the prior art. In addition, pairs of conductors are separated and substantially isolated from one another along virtually the entire length of housing 13. FIG. 7 is a cross-sectional elevation view along the line A—A of FIG. 5, where it can be seen that septa 43 and 46 extend to the cable receiving end face 27. Bore 17 is tapered as shown, gradually narrowing in dimension from the end 27 toward the end 23. The purpose and function of this taper will be more apparent hereinafter.

Compression Ring

Figure 8:
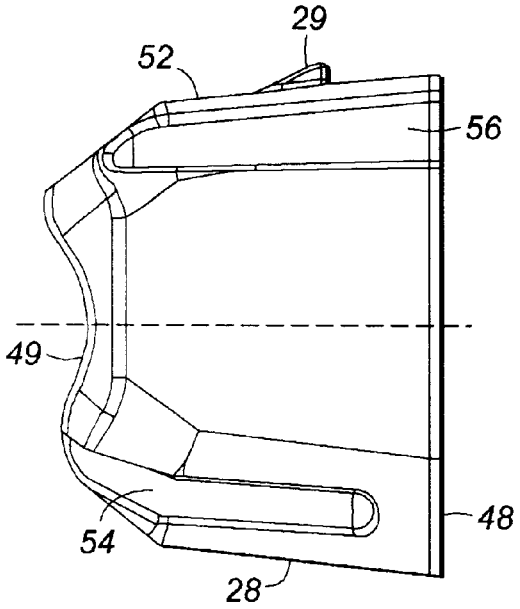
FIGS. 8, 9, 10, and 11 are, respectively, a side elevation view, a front elevation view, a rear elevation view, and a plan view of the compression ring of the invention.
Figure 9:
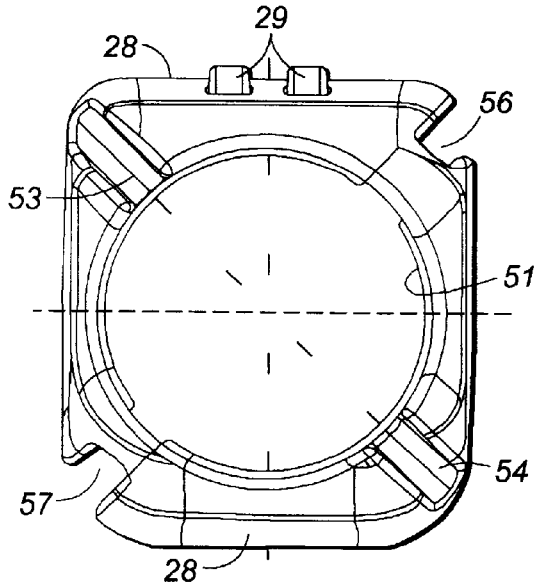
Figure 10:
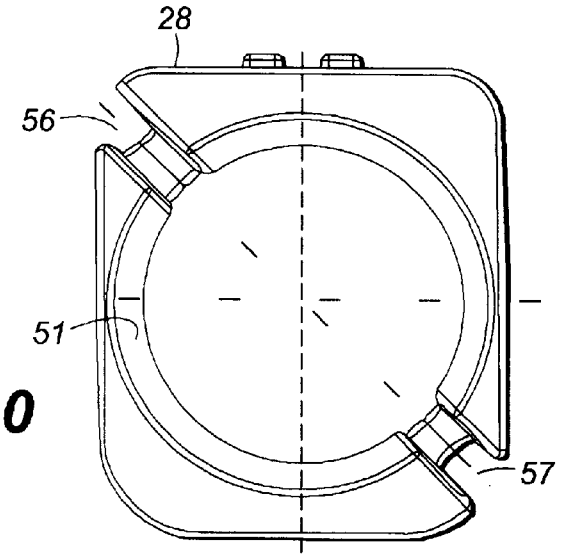
Figure 11:
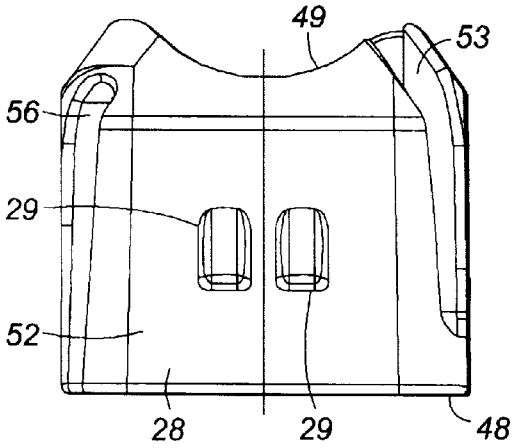
Figure 12:
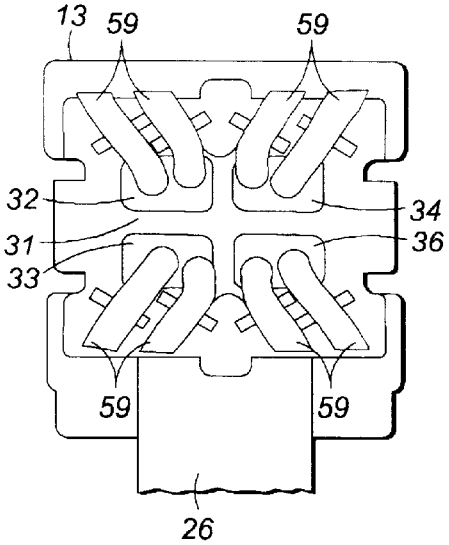
FIG. 12 is a diagrammatic view of the front face of the plug of the invention with insulated conductors in place.
Figure 13:
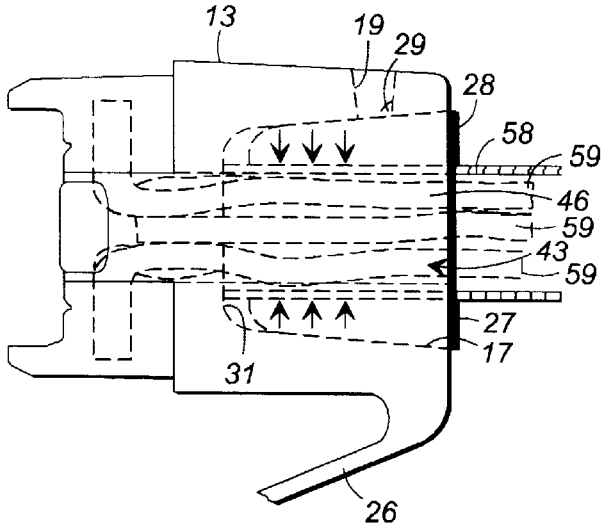
FIG. 13 is a diagrammatic view of the side of the plug of the invention with the cable and conductors in place.

FIGS. 8, 9, 10, and 11 are, respectively, a side elevation view; a front elevation view; a rear elevation view; and a top plan view of compression ring 28, which is preferably made of a suitable plastic material such as a polycarbonate. Ring 28 has a rear end 48 and a front end 49 and a circular bore 51 extending therethrough, dimensioned to receive the cable to be terminated, as represented by the dashed lines in FIG. 8. The ring 28, which has a substantially rectangular shape, tapers from the rear face 48 towards the front face 49, with the front face edges being slightly rounded as best seen in FIGS. 8 and 11. On the top surface 52 of ring 28 are first and second wedge shaped latch projections 29 which are adapted to engage the edge of opening 19 in the top surface 18 of housing 13 for the purpose of securing ring 28 within the tapered bore 17 of housing 13. While wedge shaped latches are shown, other means of securing the ring 28 within the bore 17, such as spring or cantilevered latches, for example, might be used. Extending from front face 49 toward the rear of ring 28 are first and second diametrically opposed slots 53 and 54, which, as can be seen, do not extend all the way to the rear face 48. Slots 53 and 54 are cut through the walls of ring 28 to communicate with bore 51. In like manner, third and fourth diametrically opposed slots 56 and 57 which extend from rear face 48 toward the front face 49, but stop short thereof, as seen in FIGS. 8 and 11. Slots 56 and 57, which are preferably spaced ninety degrees (90°) from slots 53 and 54, respectively, also extend through the walls of ring 28 to communicate with bore 51. The slots 53, 54, 56, and 57 impart a degree of flexibility, or more properly, compressibility to ring 28 so that, as it is pushed forward into tapered bore 17 of member 13, it is compressed uniformly around the cable which it surrounds, until the latching members 29 engage the edge of opening 19. This process can be more readily seen with reference to FIGS. 12 and 13, which are diagrammatic views of housing 13 and ring 28 as assembled with a cable 58 and its insulated conductors 59 inserted therein. FIGS. 12 and 13 make clear the unique features of the present invention especially where compared to FIGS. 14 and 15, which represent the arrangement of the Chapman et al. application Ser. No. 08/822,621.

Figure 14:
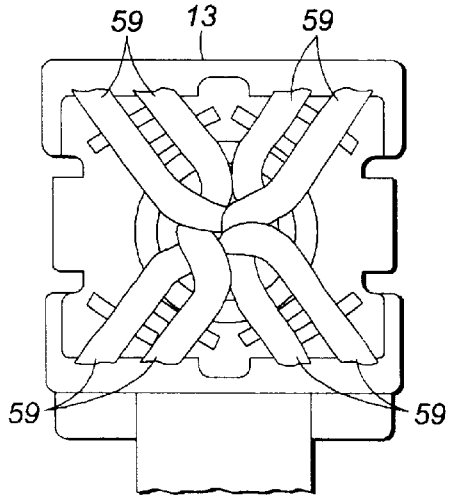
FIG. 14 is a diagrammatic view of the front face of a prior strain relief plug.
Figure 15:
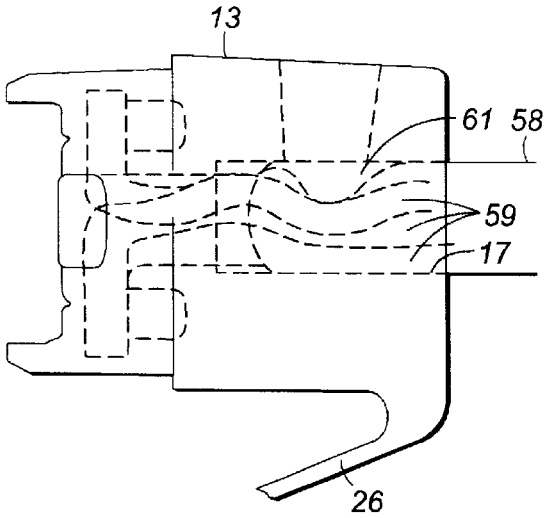
FIG. 15 is a diagrammatic view of the side of the prior plug of FIG. 14.

In FIGS. 14 and 15, it can be seen that the conductors 59 (for simplicity, the same reference numerals are used for the same or similar parts) emerge from the end of cable 58 in a forward region of housing 13. Inasmuch as the conductors 59 within the cable 58 are arranged as twisted pairs, and the pairs themselves are twisted together, the particular conductor arrangement at the cable end is not predictable and, further, there is insufficient space in which to organize the conductors for optimum results. Consequently, the conductors remain twisted and centrally grouped up to the point where they are fanned out to the four comers, as best seen in FIG. 14. Such an organization of conductors can result in undesirably high crosstalk levels. One reason for this extension of the cable end toward the front of the housing 13 is the anchor bar 61 which anchors the cable 58 within member 13 by exerting pressure on the cable to force it tightly against the opposite interior wall of bore 17. This has the effect of squeezing the twisted conductors 59 tightly against each other and the side of the cable which in turn is squeezed tightly against the wall of bore 17. Such an anchor bar arrangement works quite well with ribbon cable, but can produce undesirable variations in the transmission characteristics of the cable and connector when the cable is circular and contains numerous twisted pairs of conductors. It can be readily appreciated that the arrangement shown in FIG. 15 can produce unpredictable increases in crosstalk. Compensation for crosstalk can be accomplished by special arrangements of the lead frames in the jack interface housing. However, wide variations in crosstalk from connector to connector or, more particularly, from strain relief housing to strain relief housing, make it difficult to optimize or even to manage, crosstalk compensation.

The arrangement of the invention, as depicted in FIGS. 12 and 13, by means of divider 12 and openings 32, 33, 34, and 36 facilitates an organization of the conductor pairs, and the individual conductors regardless of at what point they are emergent from the cable. The septa 42, 43, 44, and 46 penetrate into the cable, as seen in FIG. 13, hence the conductors are routed along their designated channels over practically the entire length of member 13, thereby separating and segregating the conductor pairs and the conductors. Compression ring 28 applies a uniform clamping force to the cable, as indicated by the arrows in FIG. 13, and the septa function to prevent the pairs from being squeezed together, a condition depicted in FIG. 15. Cable clamping or anchoring is, therefore, achieved without disturbing the orderly arrangement of the conductors and conductor pairs. As a consequence, even though crosstalk may not be completely eliminated, what crosstalk there is, is substantially non-varying from connector to connector and hence there is a large increase in predictability of transmission characteristics.

Compression ring 28 is the subject of co-pending application Ser. No. 09/126,042 filed concurrently herewith.

In concluding the detailed description, it should be noted that it will be obvious to those skilled in the art that many variations and modifications may be made to the preferred embodiment without substantial departure from the principles of the present invention. All such variations and modifications are intended to be included herewith as being within the scope of the present invention, as set forth in the claims hereinafter. Further, in the claims, the corresponding structures, materials, acts and equivalents of all means or step plus function elements are intended to include any structure, material, or acts for performing the functions with other claimed elements as specifically claimed.

I claim:

1. A strain relief plug for use in a modular connector, the modular connector being adapted to terminate a cable carrying conductors, said strain relief plug comprising:

a housing member having a connector end and connector end face and a cable entrance end and cable entrance end face;

a bore extending between said faces;

a divider member in said bore in the region of said connector end face, said divider forming a plurality of channel openings; and a channel forming member extending from said divider member toward said cable entrance for forming channels defined by said openings, said channel forming member having a plurality of septa arranged in a cruciform shape.

2. A strain relief plug as claimed in claim 1, and further comprising a first plurality of spaced projections extending outwardly from said connector end face for positioning conductors in the cable being terminated, and wherein said divider has a longitudinal axis such that the conductors form an array substantially radially-spaced from said longitudinal axis of said divider.

3. A strain relief plug as claimed in claim 2, wherein the conductors are in the form of wire pairs and said strain relief plug has a second plurality of spaced projections extending outwardly from said connector end face for segregating the wire pairs of the cable being terminated from each other in said array.

4. A strain relief plug as claimed in claim 1 wherein each of said plurality of channel openings is adapted to contain one wire pair.

5. A strain relief plug as claimed in claim 1 wherein said divider forms four channel openings.

6. A strain relief plug as claimed in claim 1 and further including an anchor member for anchoring the cable being terminated within said bore.

7. A strain relief plug as claimed in claim 6, wherein said anchor member comprises a compression ring having a first end and a second end.

8. A strain relief plug as claimed in claim 6 wherein said anchor member has at least one latching member thereon for latching said anchor member to said housing member.

9. A strain relief plug as claimed in claim 6 wherein said bore is tapered from said cable entrance end toward said connector end.

10. A strain relief plug as claimed in claim 9 wherein said anchor member comprises a compression ring having a first end and a second end and is tapered from said first end to said second end to fit within said bore and be compressed thereby.

11. A strain relief plug as claimed in claim 1, and further including an anchor member for anchoring the cable being terminated within said bore.

12. A strain relief plug as claimed in claim 11, wherein said anchor member has at least one latching member thereon for latching said anchor member to said housing member.

13. A strain relief plug as claimed in claim 11, wherein said bore is tapered from said cable entrance end toward said connector end.

14. A strain relief plug as claimed in claim 11, wherein said anchor member comprises a compression ring having a first end and a second end and is tapered from said first end to said second end to fit within said bore and be compressed thereby.

15. A strain relief plug for use in a modular connector, the modular connector being adapted to terminate a cable carrying conductors in the form of wire pairs, said strain relief plug comprising:

a housing member having a connector end and connector end face and a cable entrance end and cable entrance end face;

a bore extending between said faces;

a divider member in said bore in the region of said connector end face, said divider having a longitudinal axis and forming a plurality of channel openings;

a channel forming member extending from said divider member toward said cable entrance for forming channels defined by said openings;

a first plurality of spaced projections extending outwardly from said connector end face for positioning the conductors such that the conductors form an array substantially radially-spaced from said longitudinal axis of said divider; and a second plurality of spaced projections extending outwardly from said connector end face for segregating the wire pairs of the conductors from each other in said array.

16. A strain relief plug as claimed in claim 15, wherein said channel forming member has a plurality of septa arranged in a cruciform shape.

* * * * *